US007426770B2

(12) United States Patent
Moon

(10) Patent No.: US 7,426,770 B2
(45) Date of Patent: Sep. 23, 2008

(54) ROTATING BRUSH DRIVING CONTROL APPARATUS FOR VACUUM CLEANER

(75) Inventor: Joo-sung Moon, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 54 days.

(21) Appl. No.: 11/490,387

(22) Filed: Jul. 20, 2006

(65) Prior Publication Data

US 2007/0163074 A1 Jul. 19, 2007

(30) Foreign Application Priority Data

Jan. 17, 2006 (KR) ..... 10-2006-0004819

(51) Int. Cl.
*A47L 5/10* (2006.01)
*A47L 5/26* (2006.01)

(52) U.S. Cl. ..... 15/390; 15/389; 15/391

(58) Field of Classification Search ..... 15/389, 15/390, 391
See application file for complete search history.

(56) References Cited

U.S. PATENT DOCUMENTS 4,748,714 A * 6/1988 Tschudy ..... 15/390
5,537,712 A * 7/1996 Weber et al. ..... 15/391
6,044,520 A * 4/2000 Yamamoto ..... 15/390
6,158,084 A 12/2000 Weber et al. ..... 15/390

* cited by examiner

*Primary Examiner*—Joseph J. Hail, III
*Assistant Examiner*—Shantese L McDonald
(74) *Attorney, Agent, or Firm*—Ohlandt, Greeley, Ruggiero & Perle, LLP.

(57) ABSTRACT

The present disclosure relates to a rotating brush driving control apparatus. The rotating brush driving control apparatus includes a supporting bracket disposed in a suction brush assembly; a moving member slidably and elastically disposed in the supporting bracket; a lever disposed above a driving belt, the lever having an end rotatably disposed at a side of the supporting bracket; a tension spring elastically connecting the moving member and the lever; and a locking member disposed below the moving member, the locking member locking or unlocking the moving member in turn according as the moving member is downwardly pressed; wherein, when the locking member locks the moving member, the other end of the lever press the driving belt by the tension spring so that the driving belt transmits the driving power to the rotating brush.

17 Claims, 8 Drawing Sheets

ROTATING BRUSH DRIVING CONTROL APPARATUS FOR VACUUM CLEANER

CROSS-REFERENCE TO RELATED APPLICATIONS

This application claims the benefit under 35 U.S.C. § 119 (a) from Korean Patent Application No. 2006-0004819 filed Jan. 17, 2006 in the Korean Intellectual Property Office, the disclosure of which is incorporated herein by reference in its entirety.

BACKGROUND OF THE INVENTION

1. Field of the Invention

The present disclosure relates to a vacuum cleaner. More particularly, the present disclosure relates to a rotating brush driving control apparatus for a vacuum cleaner to control driving of a rotating brush for cleaning a surface to be cleaned.

2. Description of the Related Art

Generally, a vacuum cleaner has a suction motor, and draws in contaminants using suction force generated by the suction motor so as to clean a surface to be cleaned. Nowadays, vacuum cleaners are being marketed that have a substantially drum-shape rotating brush with bristles fixed in a helical shape on an outer circumferential surface thereof. Therefore, the vacuum cleaners can clean contaminants on a surface to be cleaned that it is difficult to clean by simply drawing-in contaminants.

However, the rotating brush is not always required for cleaning work. For examples, when users wants to prevent noise from being generated by friction between the rotating brush and the surface to be cleaned for more quite cleaning work, or when users clean a surface to be cleaned that can be damaged by friction of the rotating brush, driving the rotating brush is not required.

At this time, after users stop the rotating brush and hold a cleaner body of the vacuum cleaner, the users perform a cleaning work using extension hoses or accessories. Therefore, the cleaning work is inconvenient to users.

In order to solve the above problem, vacuum cleaners have been developed that can selectively control driving of the rotating brush according to the state of a surface to be cleaned or a cleaning environment. An example of this type of vacuum cleaner is disclosed in U.S. Pat. No. 6,158,084. The vacuum cleaner controls driving of the rotating brush by adjusting the tension of a driving belt. However, the conventional rotating brush driving control apparatus has a very complex structure so that it is not easy to maintain the vacuum cleaner. Also, there is another problem with the complex structure in that the manufacturing cost of the vacuum cleaner is increased. Therefore, there is a continuing need for vacuum cleaners that overcome one or more of the aforementioned and other problems of the prior vacuum cleaners.

SUMMARY OF THE INVENTION

The present disclosure has been developed in order to overcome the above drawbacks and other problems associated with the conventional arrangement. An aspect of the present disclosure is to provide a rotating brush driving control apparatus for a vacuum cleaner capable of easily controlling driving of a rotating brush with a simple structure.

The above aspect and/or other feature of the present disclosure can substantially be achieved by providing a rotating brush driving control apparatus for a vacuum cleaner, that applies the tension force to a driving belt connecting a motor disposed in a cleaner body and a rotating brush disposed in a suction brush assembly so as to control driving of the rotating brush. The rotating brush driving control apparatus includes: a supporting bracket disposed in the suction brush assembly; a moving member slidably and elastically disposed in the supporting bracket; a lever disposed above the driving belt, the lever having an end rotatably disposed at a side of the supporting bracket; a tension spring elastically connecting the moving member and the lever; and a locking member disposed below the moving member, the locking member locking or unlocking the moving member in turn according as the moving member is downwardly pressed; wherein, when the locking member locks the moving member, the other end of the lever press the driving belt by the tension spring so that the driving belt transmits the driving power to the rotating brush, and wherein, when the locking member unlocks the moving member, the tension spring releases the other end of the lever from the driving belt.

The moving member includes a sliding part slidably disposed in the supporting bracket; a vertical bar extended from an upper side of the sliding part through the suction brush assembly; and a pedal formed at a top end of the vertical bar. Therefore, users simply step the pedal protruded outside the suction brush assembly to transmit the driving power to the rotating brush or to prevent the driving power from being transmitted to the rotating brush.

The tension spring determines the tension force applied to the driving belt. Therefore, when the driving belt grows longer due to a long usage, another tension spring with different strength can be used to apply a predetermined tension force to the driving belt.

The lever may include a pulley rotatably disposed at the other end of the lever so as to be in rotating contact with the driving belt, wherein, when the lever presses the driving belt, the friction force between the lever and the driving belt is minimized.

The locking member includes: a return spring disposed inside the supporting bracket so as to elastically support a bottom end of the moving member; a guiding portion formed inside the sliding part; and a torsion spring having an end fixed at a bottom surface of the supporting bracket and the other end corresponding to the guiding portion, wherein, when the moving member is pressed, the torsion spring is moved along the guiding portion so as to lock and unlock the moving member.

The guiding portion may include a first guiding projection having an upwardly guiding surface guiding the other end of the torsion spring in an upwardly inclined direction, a downwardly guiding surface guiding the other end of the torsion spring in a downwardly inclined direction, and a hooking groove formed at an upper side of the first guiding projection to receive the other end of the torsion spring; and a second guiding projection nearly formed above the hooking groove of the first guiding projection so as to help the other end of the torsion spring to be received in and to be left from the hooking groove.

The guiding portion further comprises at least one third guiding projection continuously guiding the other end of the torsion spring moving along the downwardly guiding surface to return an original position.

Other objects, advantages and salient features of the disclosure will become apparent from the following detailed description, which, taken in conjunction with the annexed drawings, discloses preferred embodiments of the disclosure.

BRIEF DESCRIPTION OF THE DRAWINGS

These and/or other aspects and advantages of the disclosure will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION OF THE EXEMPLARY EMBODIMENT

Hereinafter, certain exemplary embodiments of the present disclosure will be described in detail with reference to the accompanying drawings.

The matters defined in the description, such as a detailed construction and elements thereof, are provided to assist in a comprehensive understanding of the disclosure. Thus, it is apparent that the present disclosure may be carried out without those defined matters. Also, well-known functions or constructions are omitted to provide a clear and concise description of exemplary embodiments of the present disclosure.

Figure 1:
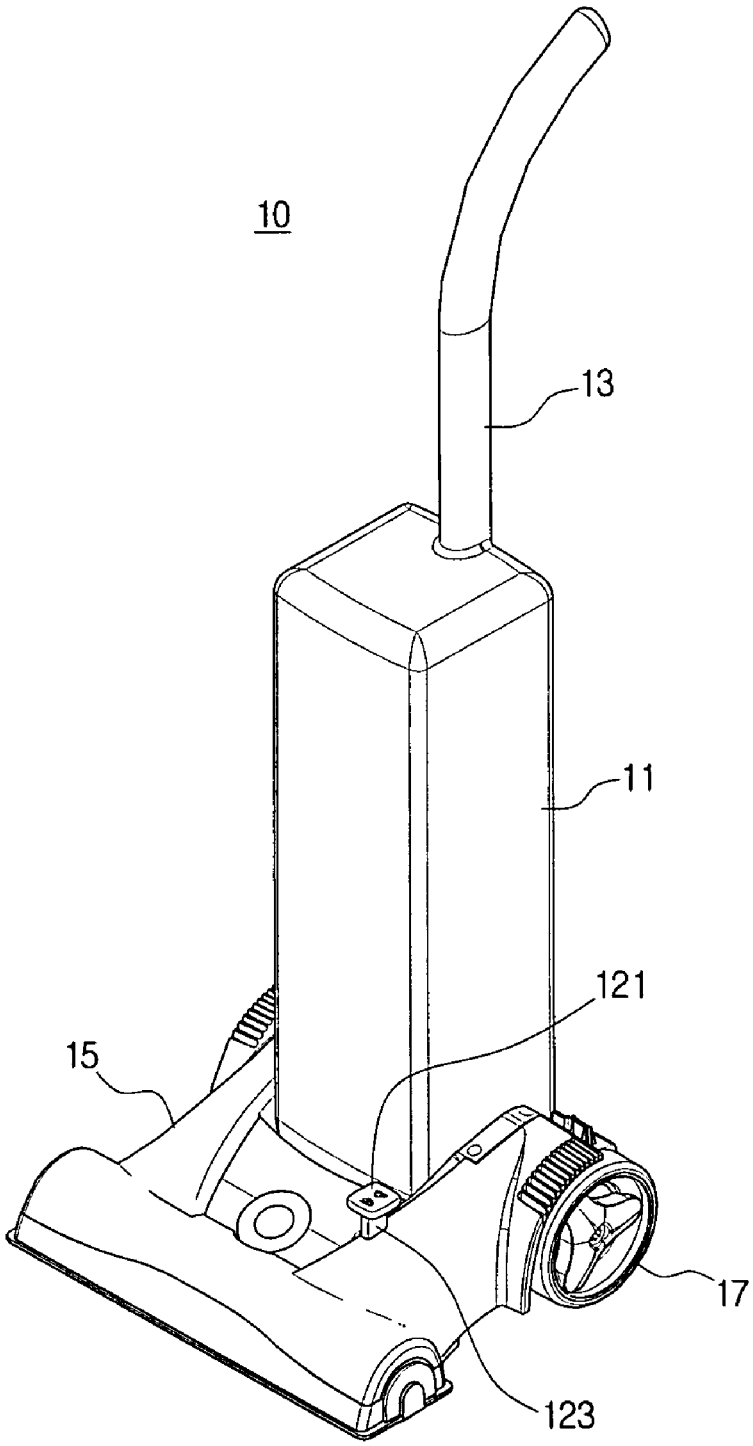
FIG. 1 is a perspective view illustrating a vacuum cleaner employing a rotating brush driving control apparatus according to an embodiment of the present disclosure.
Figure 2:
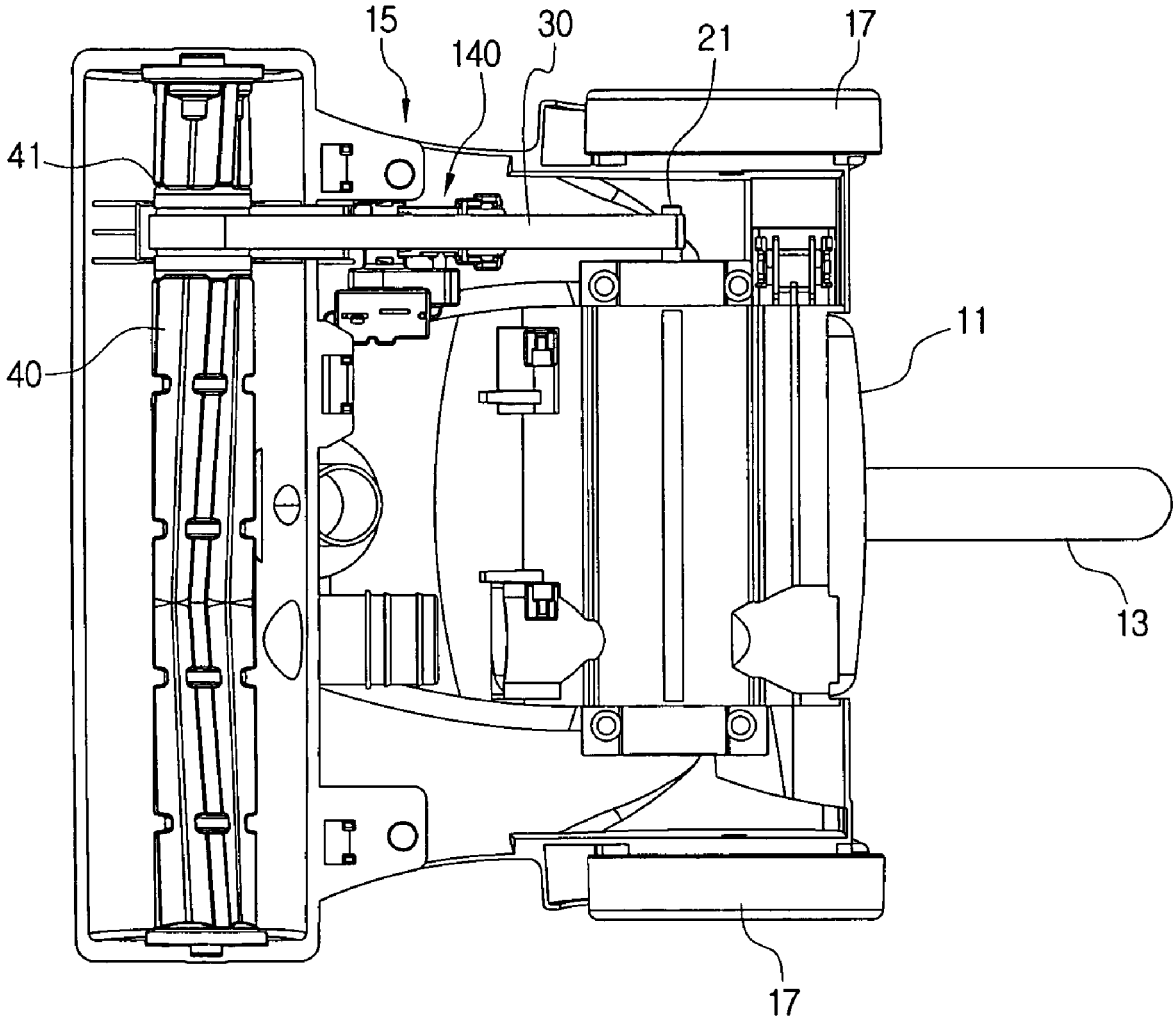
FIG. 2 is a bottom view illustrating the vacuum cleaner of FIG. 1.
Figure 3:
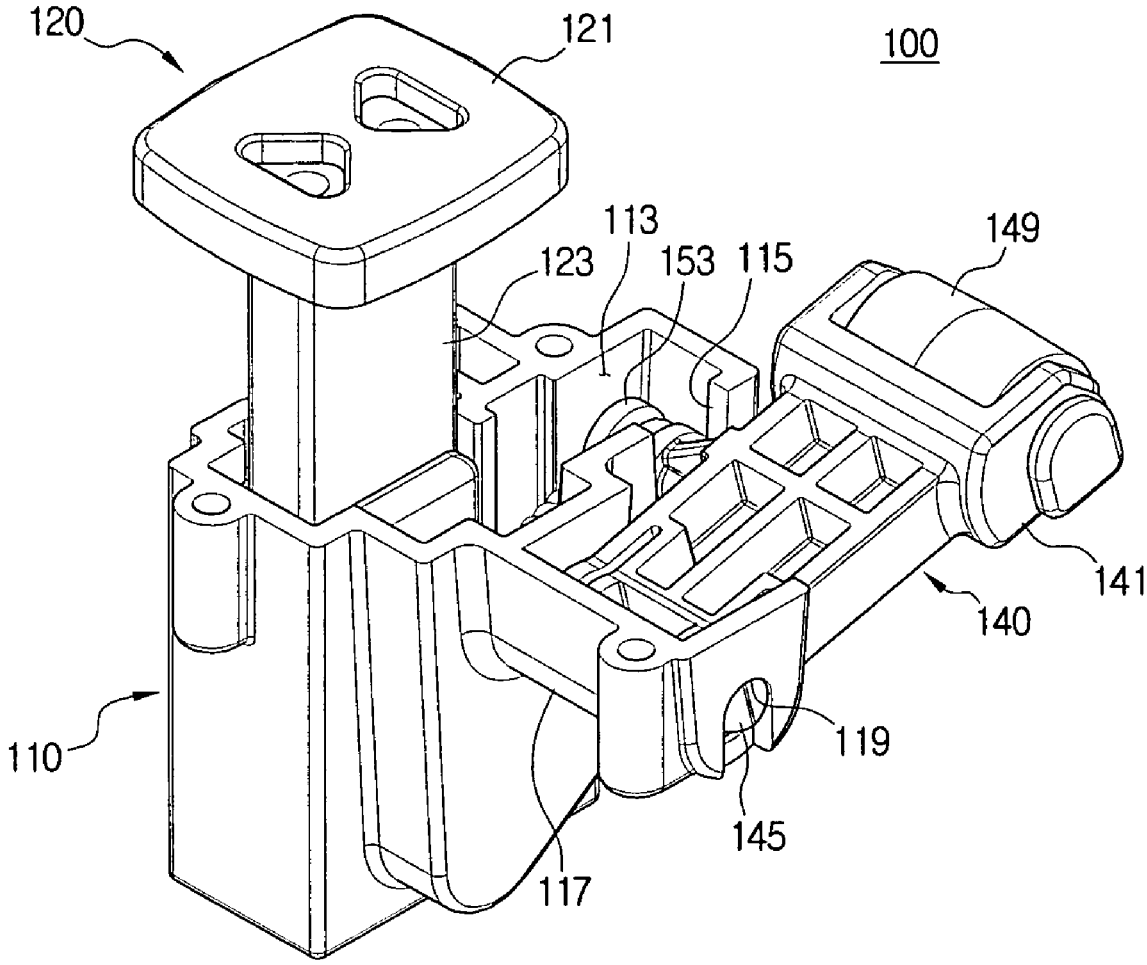
FIG. 3 is a perspective view illustrating a rotating brush driving control apparatus according to an embodiment of the present disclosure disposed in a suction brush assembly of the vacuum cleaner of FIG. 1.
Figure 4:
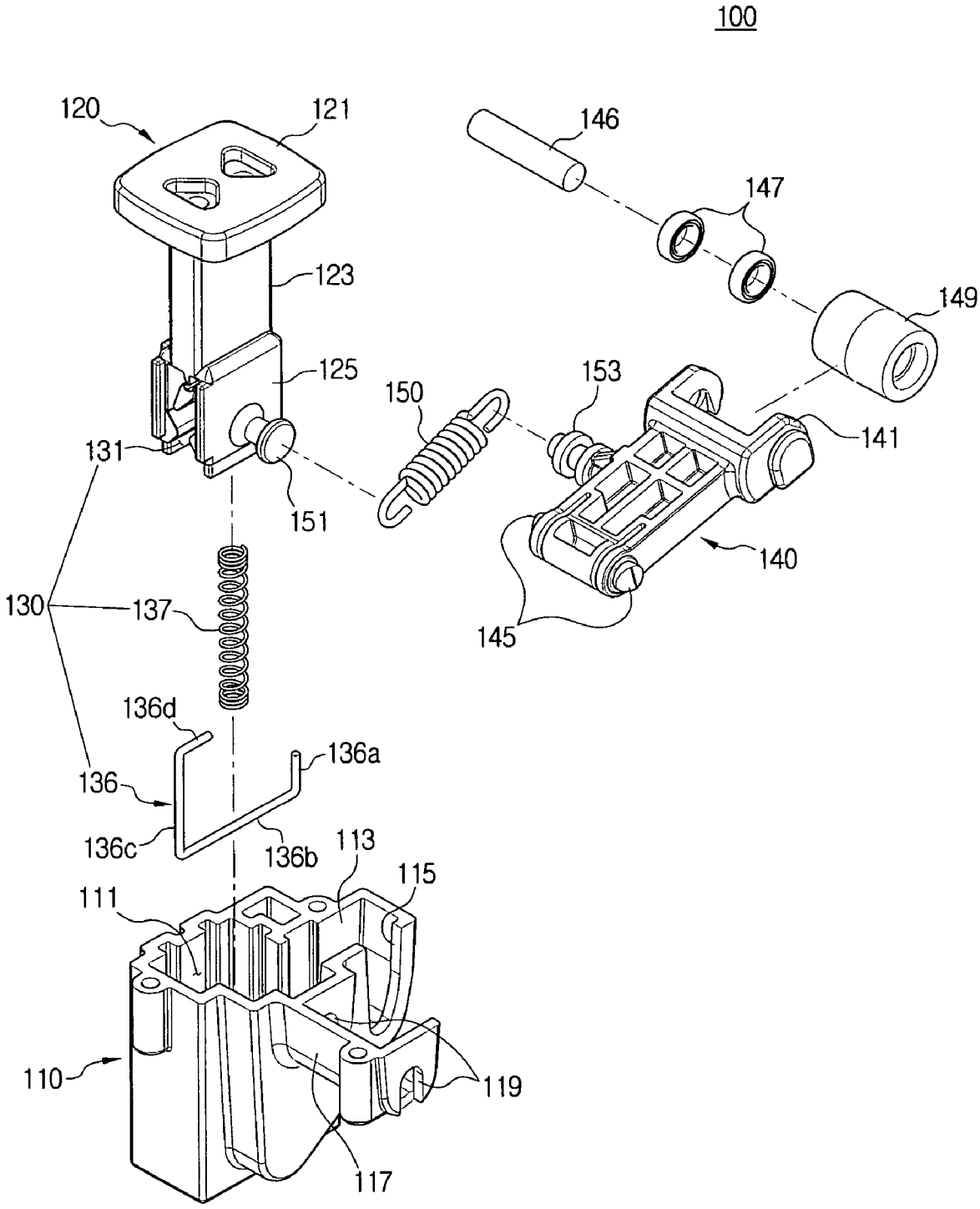
FIG. 4 is an exploded perspective view illustrating the rotating brush driving control apparatus of FIG. 3.
Figure 5:
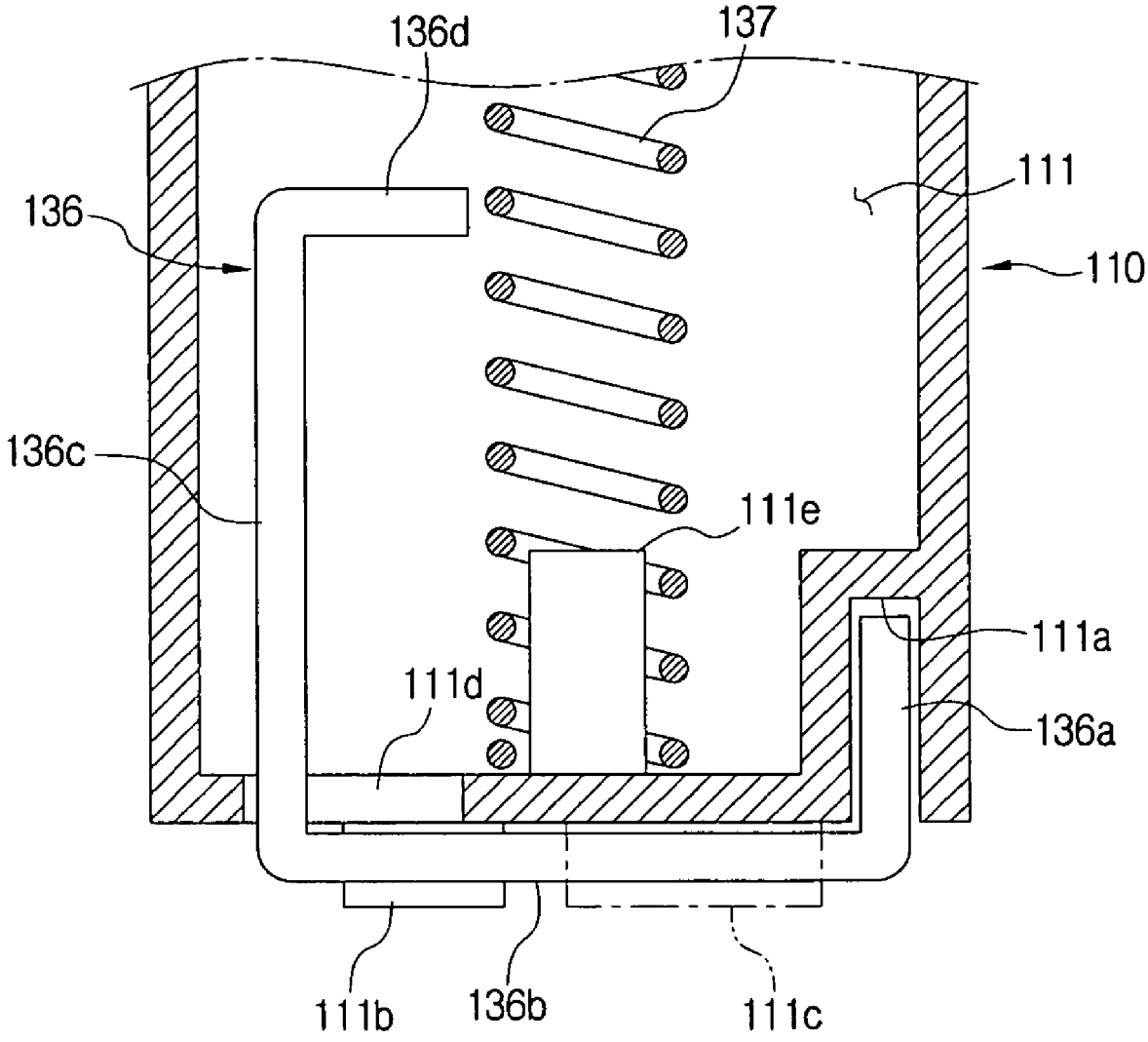
FIG. 5 is a sectional schematic view illustrating a torsion spring disposed in a supporting bracket of FIG. 4.

FIG. 1 is a perspective view illustrating a vacuum cleaner employing a rotating brush driving control apparatus according to an embodiment of the present disclosure, FIG. 2 is a bottom view illustrating the vacuum cleaner of FIG. 1, FIG. 3 is a perspective view illustrating a rotating brush driving control apparatus according to an embodiment of the present disclosure disposed in a suction brush assembly of the vacuum cleaner of FIG. 1, FIG. 4 is an exploded perspective view illustrating the rotating brush driving control apparatus of FIG. 3, and FIG. 5 is a sectional schematic view illustrating a torsion spring disposed in a supporting bracket of FIG. 4.

In the below description, a upright type vacuum cleaner 10 is used as an example of vacuum cleaners employing a rotating brush driving control apparatus according to an embodiment of the present disclosure as shown in FIG. 1; however, this should not be considered as limiting. Various types of vacuum cleaners such as upright type vacuum cleaners, handy type vacuum cleaners, vacuum cleaners wherein a suction brush assembly is connected with a cleaner body via a flexible hose, and so on may employ a rotating brush driving control apparatus according to an embodiment of the present disclosure.

Referring to FIG. 1, a vacuum cleaner 10 includes a cleaner body 11 having a handle 13 on an upper side thereof, and a suction brush assembly 15 pivotally disposed at an under side of the cleaner body 11. Also, the vacuum cleaner 10 further includes a pair of wheels 17 disposed at opposite sides of the suction brush assembly 15 so as to smoothly move on a surface to be cleaned.

The suction brush assembly 15 has a rotating brush 40 rotatably disposed at a bottom surface of the suction brush assembly 15 as shown in FIG. 2. The rotating brush 40 is connected with a driving shaft 21 of a motor 20 (see FIG. 7*a*) via a driving belt 30.

Figure 7A:
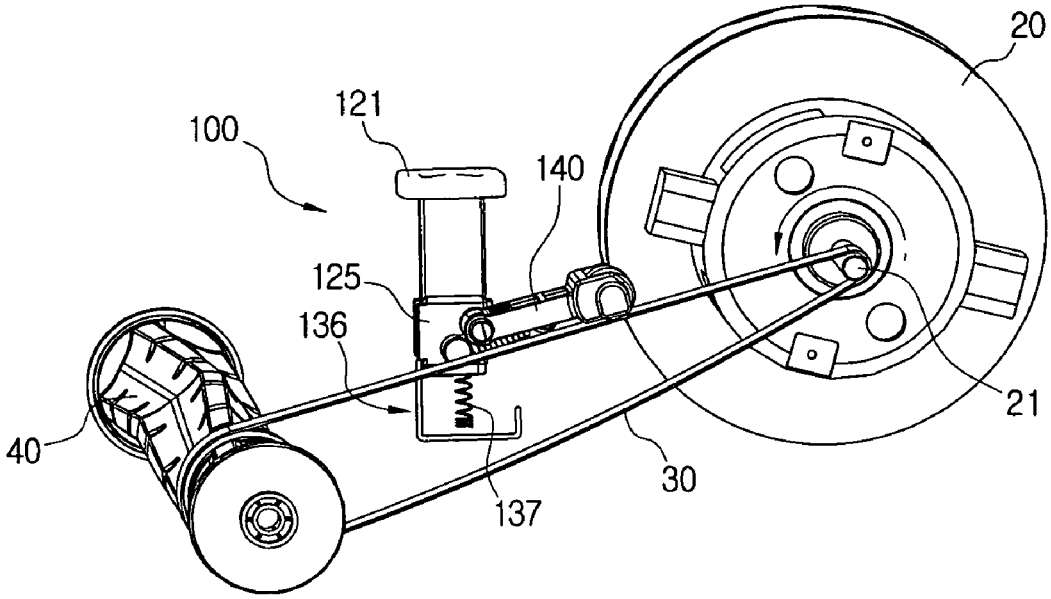
FIG. 7*a* is a schematic view illustrating a driving belt before operation of a rotating brush driving control apparatus according to an embodiment of the present disclosure.

A rotating brush driving control apparatus 100, shown in FIGS. 3 and 4, is disposed inside the suction brush assembly 15 to selectively apply the tension force on the driving belt 30 so that the driving power of the motor 20 is selectively transmitted to the rotating brush 40. Also, the rotating brush driving control apparatus 100 is arranged nearby the driving belt 30 between the motor 20 and the rotating brush 40 as shown in FIG. 7*a*.

Referring to FIGS. 3 and 4, the rotating brush driving control apparatus 100 includes a supporting bracket 110, a moving member 120, a locking member 130, a lever 140, and a tension spring 150.

The supporting bracket 110 is disposed inside the suction brush assembly 15, and has a first receiving space 111 into which an under portion of the moving member 120 is slidably inserted in a vertical direction. The supporting bracket 110 has a second receiving space 113 in fluid communication with the first receiving space 111. The tension spring 150 is inserted into the second receiving space 113. Also, an extension part 117 is formed at a side of the second receiving space 113 so as to support an end of the lever 140. In opposite sides of the extension part 117, there is formed a pair of connecting holes 119 with which a pair of pivot projections 145 of the lever 140 is connected.

The moving member 120 includes a sliding part 125 slidably disposed at the supporting bracket 110 and a vertical bar 123 extending from an upper side of the sliding part 125 through an top surface of the suction brush assembly 15 as shown in FIG. 1, and a pedal 121 disposed on a top end of the vertical bar 123. The pedal 121 has a predetermined area so that users can press the moving member 120.

A guiding portion 131 is formed inside the sliding part 125 so that the guiding portion 131 guides an end, namely a hooking part 136*d*, of a torsion spring 136 according as the moving member 120 rises or lowers as described below.

The locking member 130 is disposed below the moving member 120 so as to lock or unlock the moving member 120 in turn according as the moving member 120 is downwardly pressed. The locking member 130 includes the guiding portion 131, the torsion spring 136, and a return spring 137.

Figure 6A:
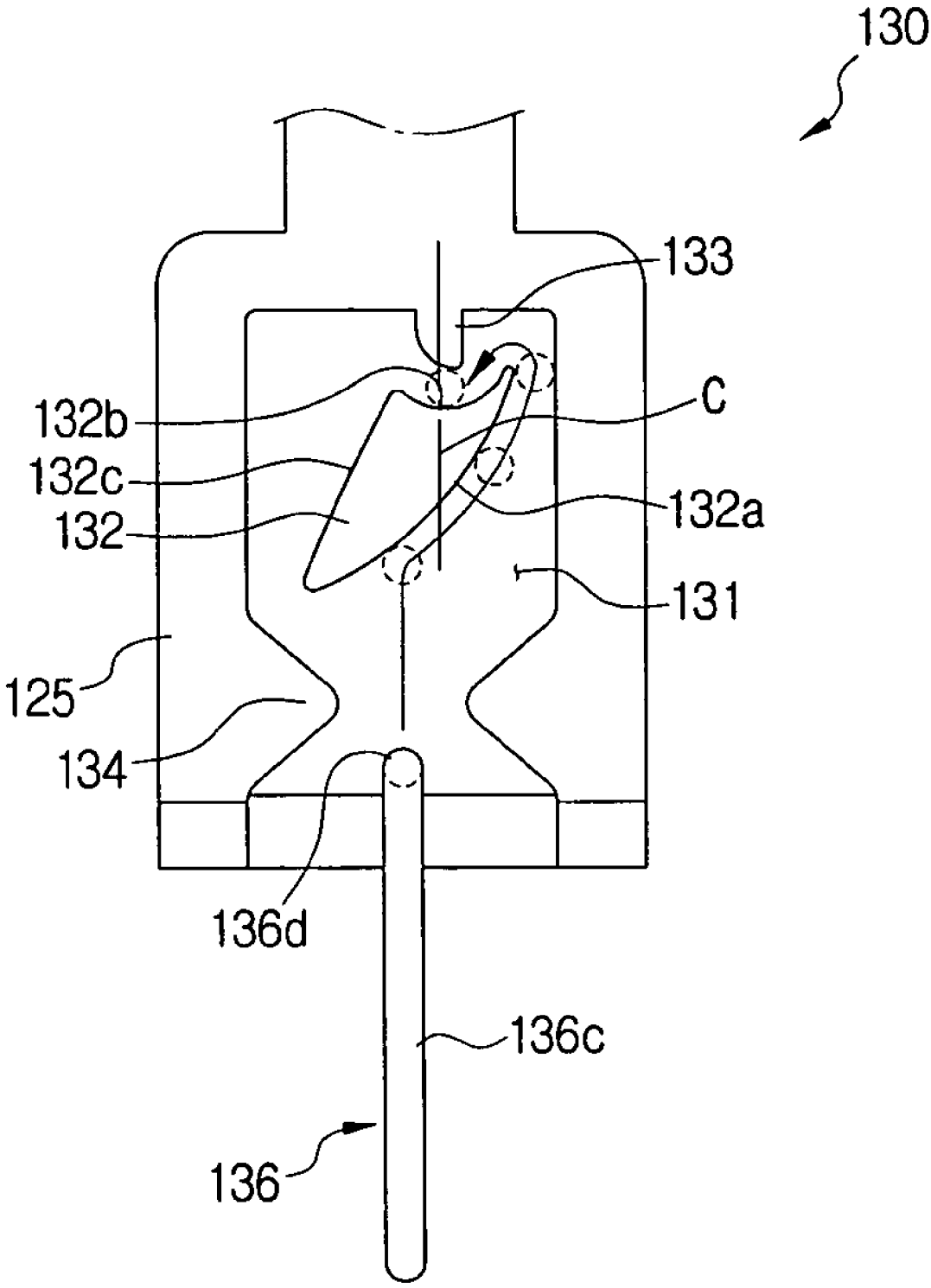
FIG. 6*a* is a schematic view illustrating a locking member before operation of a rotating brush driving control apparatus according to an embodiment of the present disclosure.
Figure 6B:
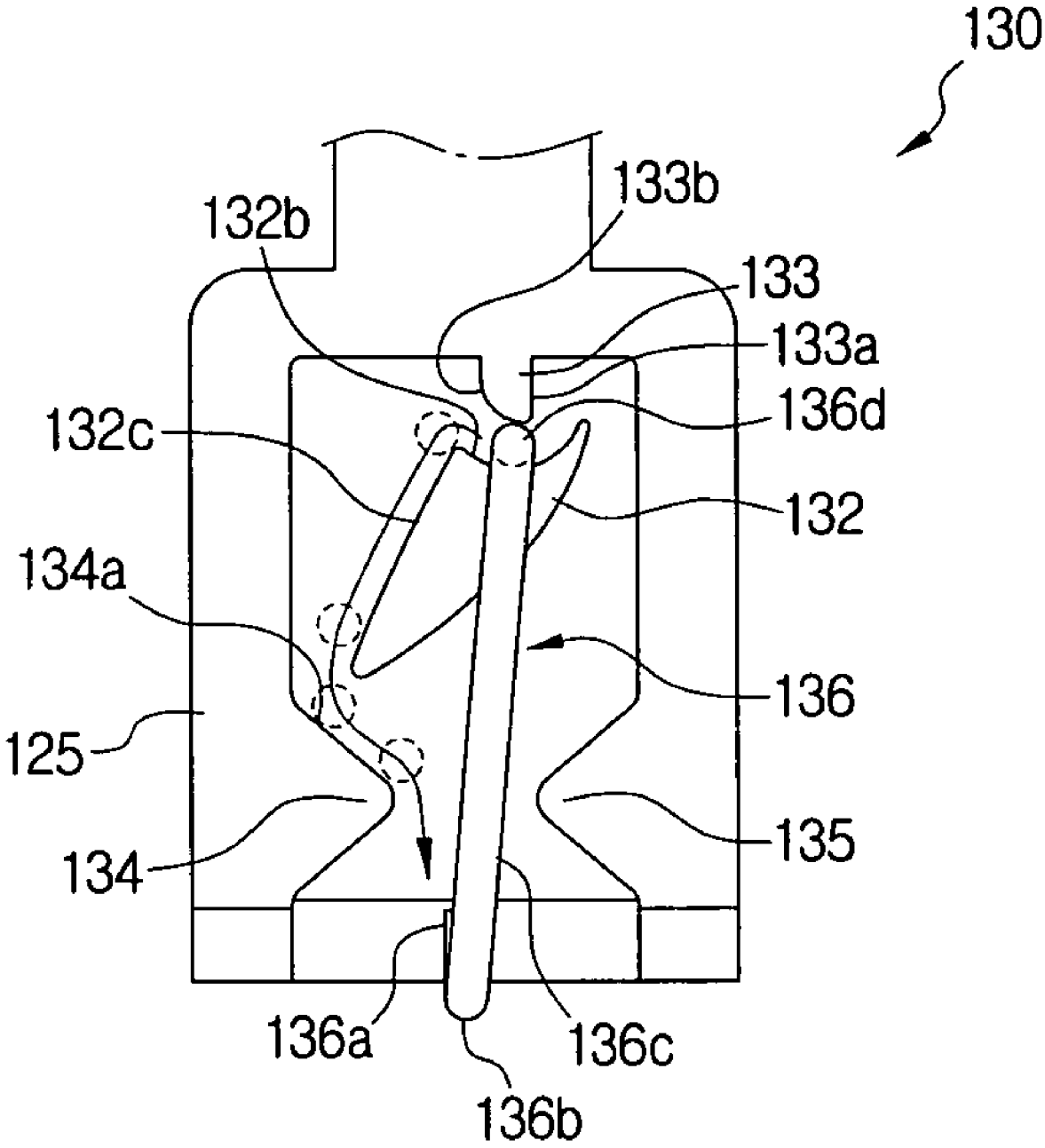
FIG. 6*b* is a schematic view illustrating the locking member after operation of the rotating brush driving control apparatus.

The guiding portion 131 has a first, second, and third guiding projections 132, 133, and 134 therein as shown in FIGS. 6*a* and 6*b*. The first guiding projection 132 has an upwardly guiding surface 132*a* guiding the hooking part 136*d* of the torsion spring 136 in an upwardly inclined direction, a downwardly guiding surface 132*c* guiding the hooking part 136*d* of the torsion spring 136 in a downwardly inclined direction, and a hooking groove 132*b* formed on an upper side of the first guiding projection 132 in a substantially arc shape so as to receive the hooking part 136*d*. A center C of the hooking groove 132*b* is spaced apart from a vertical part 136*c* of the torsion spring 136 in a lateral direction as shown in FIG. 6*a*.

As a result, when the hooking part 136*d* is received in the hooking groove 132*b*, some torsional force is applied to a horizontal part 136*b* of the torsion spring 136 so that the hooking part 136*d* can be easily left from the hooking groove 132*b* by the torsional force after this. The second guiding projection 133 is nearly formed above the hooking groove 132*b* of the first guiding projection 132 so that it helps the hooking part 136*d* to be received in and to be left from the hooking groove 132*b*. The third guiding projection 134 is formed below the first guiding projection 132 so that it continuously guides the hooking part 136*d* of the torsion spring 136 moving along the downwardly guiding surface 132*c* to return an original position. Furthermore, the third guiding projection 134 may comprise a pair of third guiding projections facing each other as shown in FIG. 6*a* so as to guide the hooking part 136*d* inside and outside the guiding portion 131.

The torsion spring 136 is formed in a line shape, and includes a fixing part 136*a*, a horizontal part 136*b*, a vertical part 136*c*, and a hooking part 136*d* as shown in FIG. 5. That is, an end of the torsion spring 136 is the fixing part 136*a*, and the other end of the torsion spring 136 is the hooking part 136*d*.

The fixing part 136*a* is inserted and fixed into a fixing hole 111*a* formed at a bottom surface of the first receiving space 111 of the supporting bracket 110. The horizontal part 136*b* is bent and extended along the bottom surface of the first receiving space 111 from a rear end of the fixing part 136*a* so that a pair of fixing bits 111*b* and 111*c* supports opposite sides of the horizontal part 136*b*. The vertical part 136*c* is bent and extended from a rear end of the horizontal part 136*b* so as to be inserted by a predetermined length into the first receiving space 111 through a piercing hole 111*d* formed at the bottom surface of the first receiving space 111. The hooking part 136*d* is bent from a rear end of the vertical part 136*c* so as to be guided by the guiding portion 131 (see FIG. 4) formed inside the sliding part 125. At this time, when the hooking part 136*d* is guided in the upwardly or downwardly inclined direction according to a lowering or rising of the moving member 120, the horizontal part 136*b* receives the torsional force as much as the force rotating the hooking part 136*d* by a predetermined angle. The above-described structure and torsional force of the torsion spring 136 causes the moving member 120 to be locked or to be unlocked.

The return spring 137 is disposed between a bottom end of the sliding part 125 and the bottom surface of the first receiving space 111 of the supporting bracket 110 so as to elastically support the moving member 120. A bottom end of the return spring 137 is fixed at a supporting projection 111*e* protruded from the bottom surface of the first receiving space 111.

Hereinafter, operation of the rotating brush driving control apparatus 100 for the vacuum cleaner according to an embodiment of the present disclosure with the structure as above will be explained.

Figure 7B:
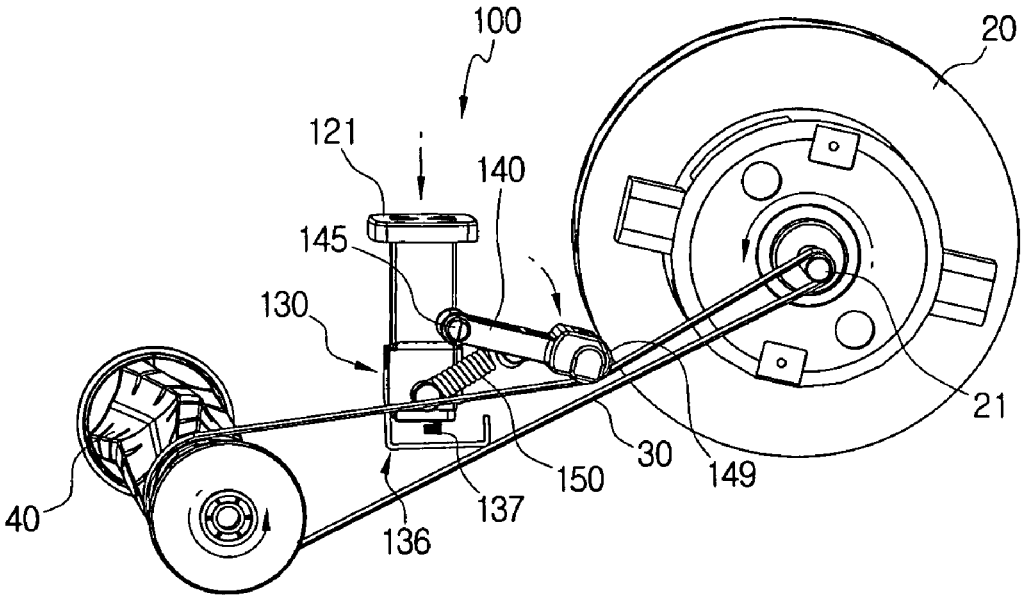
FIG. 7*b* is a schematic view illustrating the driving belt after operation of the rotating brush driving control apparatus.

FIG. 6*a* is a schematic view illustrating the locking member before the rotating brush driving control apparatus operates, FIG. 6*b* is a schematic view illustrating the locking member after operation of the rotating brush driving control apparatus, FIG. 7*a* is a schematic view illustrating the driving belt before the rotating brush driving control apparatus operates, and FIG. 7*b* is a schematic view illustrating the driving belt after the rotating brush driving control apparatus operates.

First of all, when the pedal 121 is at an initial position as shown in FIGS. 6*a* and 7*a*, the driving belt 30 loosely connects the driving shaft 21 and the rotating brush 40 with no tension force so that the driving power of the driving shaft 21 is not transmitted to the rotating brush 40.

In this state, when a user steps on the pedal 121, the sliding part 125 (see FIG. 4) of the moving member 120 supported by the return spring 137 (see FIG. 7*a*) is lowered in the first receiving space 111. At this time, the hooking part 136*d* moves along the upwardly guiding surface 132*a* of the first guiding projection 132 as shown in FIG. 6*a* so that the vertical part 136*c* is rotated by a predetermined angle with respect to the horizontal part 136*b*. As a result, the horizontal part 136*b* gets twisted in a direction so as to have the torsional force.

Then, the hooking part 136*d* moves along and presses the upwardly guiding surface 136*a* by the twist of the horizontal part 136*b* so that the hooking part 136*d* is elastically moved to the second guiding projection 133 at an end point of the upwardly guiding surface 132*a* by the torsional force of the horizontal part 136*b*. At this time, the hooking part 136*d* is stopped by a plain surface 133*a* of the second guiding projection 133.

When the user releases the pedal 121, the moving member 120 is elastically lifted at a predetermined distance by the return spring 137, and simultaneously, the hooking part 136*d* is received in the hooking groove 132*b* so that the moving member 120 is locked in a lowering position. In other words, the moving member 120 is maintained in a locking state. At this time, the vertical part 136*c* of the torsion spring 136 is slightly rotated in a side as shown in FIG. 6*b* so that some torsional force is applied to the horizontal part 136*b* of the torsion spring 136. Therefore, when the moving member 120 is unlocked as described below, the hooking part 136*d* can be easily removed from the hooking groove 132*b*.

On the other hand, when the moving member 120 is lowered, the lever 140 is downwardly rotated based on the pivot projections 145 by the tension spring 150 connected to the moving member 120 as shown in FIG. 7*b* so that the other end of the lever 140 presses the driving belt 30 via a pulley 149.

As a result, tension force is applied in the driving belt 30 connecting the driving shaft 21 and the rotating brush 40 so that the driving power of the driving shaft 21 is transmitted to the rotating brush 40 thereby rotating the rotating brush 40. Then, users can clean a surface to be cleaned using the rotating brush 40.

Hereinafter, an unlocking process of the moving member 120 will be explained. First, when users want to prevent the driving power from being transmitted to the rotating brush 40 so as to stop the rotation of the rotating brush 40, the users step on the pedal 121 so that the moving member 120 is lowered at a predetermined distance.

Simultaneously, the first and second guiding projections 132 and 133 are lowered with the moving member 120 so that the hooking part 136*d* is left from the hooking groove 132*b* and elastically moved along a round surface 133*b* of the second guiding projection 133.

Then, when the users release the pedal 121, the moving member 120 is elastically moved in an upward direction by the return spring 137, and simultaneously, the hooking part 136*d* is moved along the downwardly guiding surface 132*c* of the first guiding projection 132 by the torsional force of the horizontal part 136*b*. As a result, the horizontal part 136*b* has again the torsional force according as the vertical part 136*c* is rotated in the left direction.

The hooking part 136*d* is moved along the downwardly guiding surface 136*c*, and then, is continuously guided by anyone of the pair of third guiding projections 134. Therefore, the moving member 120 is returned to the initial position as shown in FIG. 7*a*, and the torsion spring 136 is also returned to an original position.

When the moving member 120 is unlocked, the lever 140 pressing the driving belt 30 is returned to an original position as shown in FIG. 7*a* so that the pressure applied to the driving belt 30 is released. As a result, the driving power of the driving shaft 21 is not transmitted to the rotating brush 40.

According to an embodiment of the present disclosure as described above, the rotating brush driving control apparatus for a vacuum cleaner has a simple structure so as to provide an easy maintenance and repair. Because of the simple structure, a light suction brush assembly can be provided and manufacturing cost thereof is decreased.

Also, the rotating brush driving control apparatus according to the present disclosure provides accurate locking and unlocking of the moving member so that reliability of the vacuum cleaner is increased.

Furthermore, users can easily control driving of the rotating brush by a simple action for the users to step the pedal. Therefore, it is more convenient to use the vacuum cleaner having the rotating brush driving control apparatus according to the present disclosure compared with the conventional vacuum cleaner.

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the disclosure.

What is claimed is:

1. A rotating brush driving control apparatus for a vacuum cleaner that applies the tension force to a driving belt connecting a motor disposed in a cleaner body and a rotating brush disposed in a suction brush assembly so as to control driving of the rotating brush, the rotating brush driving control apparatus comprising:

a supporting bracket disposed in the suction brush assembly;

a moving member slidably and elastically disposed in the supporting bracket;

a lever disposed above the driving belt, the lever having an end rotatably disposed at a side of the supporting bracket;

a tension spring elastically connecting the moving member and the lever; and a locking member disposed below the moving member, the locking member locking or unlocking the moving member in turn when the moving member is downwardly pressed;

wherein, when the locking member locks the moving member, the other end of the lever press the driving belt by the tension spring so that the driving belt transmits a driving power to the rotating brush, wherein, when the locking member unlocks the moving member, the tension spring releases the other end of the lever from the driving belt.

2. The rotating brush driving control apparatus of claim 1, wherein the moving member comprises:

a sliding part slidably disposed in the supporting bracket;

a vertical bar extended from an upper side of the sliding part through the suction brush assembly; and a pedal formed at a top end of the vertical bar.

3. The rotating brush driving control apparatus of claim 1, wherein the lever comprises a pulley rotatably disposed at the other end of the lever so as to be in rotating contact with the driving belt, wherein, when the lever presses the driving belt, the friction force between the lever and the driving belt is minimized.

4. The rotating brush driving control apparatus of claim 1, wherein the tension spring determines the tension force of the driving belt.

5. The rotating brush driving control apparatus of claim 1, wherein the locking member comprises:

a return spring disposed inside the supporting bracket so as to elastically support a bottom end of the moving member;

a guiding portion formed inside the moving member; and a torsion spring having an end fixed at a bottom surface of the supporting bracket and the other end corresponding to the guiding portion, wherein, when the moving member is pressed, the torsion spring is moved along the guiding portion so as to lock and unlock the moving member.

6. The rotating brush driving control apparatus of claim 5, wherein the guiding portion comprises;

a first guiding projection having an upwardly guiding surface guiding the other end of the torsion spring in an upwardly inclined direction, a downwardly guiding surface guiding the other end of the torsion spring in a downwardly inclined direction, and a hooking groove formed at an upper side of the first guiding projection to receive the other end of the torsion spring; and a second guiding projection nearly formed above the hooking groove of the first guiding projection so as to help the other end of the torsion spring to be received in and to be removed from the hooking groove.

7. The rotating brush driving control apparatus of claim 6, wherein the guiding portion further comprises at least one third guiding projection continuously guiding the other end of the torsion spring moving along the downwardly guiding surface to return an original position.

8. A rotating brush driving control apparatus for a vacuum cleaner, comprising:

a supporting bracket being disposable in a suction brush assembly of the vacuum cleaner;

a moving member slidably and elastically disposed in the supporting bracket;

a lever having an end rotatably disposed at a side of the supporting bracket and a second end configured to selectively press on a driving belt of the vacuum cleaner;

a tension spring elastically connecting the moving member and the lever; and a locking member disposed below the moving member, the locking member locking or unlocking the moving member in turn when the moving member is downwardly pressed, wherein the tension spring presses the second end of the lever on the driving belt when the locking member locks the moving member and the tension spring releases the second end from pressing on the driving belt when the locking member unlocks the moving member.

9. The rotating brush driving control apparatus of claim 8, further comprising a pulley rotatably disposed at the second end of the lever so as to be in rotating contact with the driving belt.

10. The rotating brush driving control apparatus of claim 8, wherein the moving member comprises a sliding part slidably disposed in the supporting bracket and a pedal formed at a top end of the sliding part.

11. The rotating brush driving control apparatus of claim 8, wherein the locking member comprises:

a return spring disposed inside the supporting bracket so as to elastically support a bottom end of the moving member;

a guiding portion formed inside the moving member; and a torsion spring having an end fixed at a bottom surface of the supporting bracket and the other end corresponding to the guiding portion, wherein the torsion spring moves along the guiding portion so as to lock and unlock the moving member when the moving member is pressed.

12. A vacuum cleaner comprising:

a cleaner body;

a motor disposed in the cleaner body a suction brush assembly;

a rotating brush disposed in the suction brush assembly;

a driving belt connecting the motor and the rotating brush; and rotating brush driving control apparatus for selectively controlling driving of the rotating brush, the rotating brush driving control apparatus comprising:

a moving member slidably and elastically disposed in the suction brush assembly;

a rotatable lever having an end configured to selectively press on the driving belt;

a tension spring elastically connecting the moving member and the lever; and a locking member disposed below the moving member, the locking member locking or unlocking the moving member in turn when the moving member is downwardly pressed, wherein the tension spring presses the end of the lever on the driving belt when the locking member locks the moving member and the tension spring releases the second end from pressing on the driving belt when the locking member unlocks the moving member.

13. The vacuum cleaner of claim 12, wherein the locking member comprises:

a guiding portion formed inside the moving member; and a torsion spring having an end fixed in the suction brush assembly and another end corresponding to the guiding portion, wherein the torsion spring moves along the guiding portion so as to lock and unlock the moving member when the moving member is pressed.

14. The vacuum cleaner of claim 13, wherein the locking member further comprises a return spring disposed inside the suction brush assembly so as to elastically support a bottom end of the moving member.

15. The vaccuum cleaner of claim 13, wherein the guiding portion comprises a first guiding projection having an upwardly guiding surface guiding the second end of the torsion spring in an upwardly inclined direction, a downwardly guiding surface guiding the second end of the torsion spring in a downwardly inclined direction, and a hooking groove formed at an upper side of the first guiding projection to receive the second end of the torsion spring.

16. The vacuum cleaner of claim 15, wherein the guiding portion further comprises a second guiding projection nearly formed above the hooking groove of the first guiding projection so as to help the second end of the torsion spring to be received in and to be removed from the hooking groove.

17. The vacuum cleaner of claim 16, wherein the guiding portion further comprises at least one third guiding projection continuously guiding the second end of the torsion spring along the downwardly guiding surface to return an original position.

* * * * *